US010684052B2

(12) United States Patent
Walser et al.

(10) Patent No.: US 10,684,052 B2
(45) Date of Patent: Jun. 16, 2020

(54) DIAGNOSTIC MODE OF OPERATION TO DETECT REFRIGERANT LEAKS IN A REFRIGERATION CIRCUIT

(71) Applicant: Johnson Controls Technology Company, Auburn Hills, MI (US)

(72) Inventors: Jay C. Walser, Norman, PA (US); William F. McQuade, New Cumberland, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 119 days.

(21) Appl. No.: 15/876,408

(22) Filed: Jan. 22, 2018

(65) Prior Publication Data

US 2019/0170415 A1 Jun. 6, 2019

Related U.S. Application Data

(60) Provisional application No. 62/593,578, filed on Dec. 1, 2017.

(51) Int. Cl.

| | |
|---|---|
| ***F25B 49/02*** | (2006.01) |
| ***F25B 41/06*** | (2006.01) |
| ***F25B 49/00*** | (2006.01) |

(52) U.S. Cl.

CPC ..... *F25B 49/02* (2013.01); *F25B 41/062* (2013.01); *F25B 49/005* (2013.01); *F25B 2300/00* (2013.01); *F25B 2400/19* (2013.01); *F25B 2500/222* (2013.01); *F25B 2600/01* (2013.01); *F25B 2600/0251* (2013.01); *F25B 2600/2513* (2013.01); *F25B 2700/19* (2013.01); *F25B 2700/195* (2013.01); *F25B 2700/197* (2013.01);

(Continued)

(58) Field of Classification Search

CPC ..... F25B 2300/00; F25B 2500/222; F25B 2600/2513; F25B 2700/19; F25B 41/062; F25B 49/02

See application file for complete search history.

(56) References Cited

U.S. PATENT DOCUMENTS 3,681,930 A * 8/1972 Tyree, Jr. ..... C01B 32/55 62/603

6,009,404 A 12/1999 Eimer (Continued)

FOREIGN PATENT DOCUMENTS

EP 1489368 B1 2/2012

JP 2012-184889 * 9/2012

*Primary Examiner* — Henry T Crenshaw

(74) *Attorney, Agent, or Firm* — Fletcher Yoder, P.C.

(57) ABSTRACT

The present disclosure relates to a refrigeration circuit that includes a controller communicatively coupled to a compressor, an expansion valve, and a sensor of the refrigeration circuit. The controller may activate the compressor and actuate the expansion valve such that the compressor is active while the expansion valve is closed. The controller may also measure a pressure of a refrigerant in the refrigeration circuit using the sensor while the compressor is active and the expansion valve is closed. Additionally, the controller may determine whether a refrigerant leak exists based on a maximum measurement time being reached or a time difference between a first time associated with the compressor being active while the expansion valve is closed and a second time associated with the measured pressure falling below a threshold value.

29 Claims, 6 Drawing Sheets

(52) U.S. Cl.
CPC ..... *F25B 2700/1931* (2013.01); *F25B 2700/2104* (2013.01); *F25B 2700/2106* (2013.01); *F25B 2700/21171* (2013.01)

(56) References Cited

U.S. PATENT DOCUMENTS

| | | | | |
|---|---|---|---|---|
| 9,086,232 | B1 | 7/2015 | Read | |
| 9,222,711 | B2 | 12/2015 | Ochiai et al. | |
| 2006/0254308 | A1* | 11/2006 | Yokoyama | B60H 1/3205 62/500 |
| 2011/0000234 | A1* | 1/2011 | Nishimura | F25B 49/005 62/77 |
| 2011/0112814 | A1* | 5/2011 | Clark | F25B 49/005 703/9 |
| 2013/0000340 | A1* | 1/2013 | Takayama | F25B 9/008 62/222 |
| 2014/0033753 | A1* | 2/2014 | Lu | F25B 49/02 62/190 |
| 2014/0263397 | A1* | 9/2014 | Jacobs | B67D 1/1252 222/1 |
| 2015/0219376 | A1* | 8/2015 | Douglas | F25B 49/02 62/115 |
| 2017/0198953 | A1 | 7/2017 | Connell et al. | |
| 2017/0355246 | A1* | 12/2017 | Mathe | B60H 1/00885 |
| 2018/0017299 | A1* | 1/2018 | Shockley | F25B 49/005 |
| 2018/0328628 | A1* | 11/2018 | Sun | F25B 1/10 |
| 2019/0242632 | A1* | 8/2019 | Sakae | F25B 49/02 |

* cited by examiner

DIAGNOSTIC MODE OF OPERATION TO DETECT REFRIGERANT LEAKS IN A REFRIGERATION CIRCUIT

CROSS-REFERENCE TO RELATED APPLICATION

This application is a Non-Provisional Application claiming priority to U.S. Provisional Application No. 62/593,578, entitled "DIAGNOSTIC MODE OF OPERATION TO DETECT REFRIGERANT LEAKS IN A REFRIGERATION CIRCUIT," filed Dec. 1, 2017, which is hereby incorporated by reference in its entirety for all purposes.

BACKGROUND

The present disclosure relates generally to heating, ventilating, and air conditioning (HVAC) systems, and more particularly to refrigerant leak detection for HVAC systems.

A wide range of applications exist for HVAC systems. For example, residential, light commercial, commercial, and industrial HVAC systems are used to control temperatures and air quality in residences and buildings. Generally, the HVAC systems may circulate a refrigerant through a closed refrigeration circuit between an evaporator, where the refrigerant absorbs heat, and a condenser, where the refrigerant releases heat. The refrigerant flowing within the refrigeration circuit is generally formulated to undergo phase changes within the normal operating temperatures and pressures of the system so that quantities of heat can be exchanged by virtue of the latent heat of vaporization of the refrigerant. As such, the refrigerant flowing within an HVAC system travels through multiple conduits and components of the refrigeration circuit. Inasmuch as refrigerant leaks compromise system performance or result in increased costs, it is accordingly desirable to provide detection and response systems and methods for the HVAC system to reliably detect and respond to any refrigerant leaks of the HVAC system.

SUMMARY

The present disclosure relates to a refrigeration circuit that includes a controller that is communicatively coupled to a compressor, an expansion valve, and a sensor of the refrigeration circuit. The controller may activate the compressor and actuate the expansion valve such that the compressor is active while the expansion valve is closed. The controller may also measure a pressure of a refrigerant in the refrigeration circuit using the sensor at least while the compressor is active and the expansion valve is closed. Additionally, the controller may determine whether a refrigerant leak exists based on a time difference between a first time associated with the compressor being active while the expansion valve is closed and a second time associated with the measured pressure falling below a threshold value.

The present disclosure also relates to a heating, ventilating, and air conditioning (HVAC) unit that includes a refrigeration circuit that has a compressor and an expansion valve. The HVAC unit also includes a sensor configured to measure a pressure of the refrigerant within the refrigeration circuit. Additionally, the HVAC unit includes a controller configured to activate the compressor with the expansion valve closed and to obtain a measure of the pressure of the refrigerant from the sensor. Additionally, the controller is configured to determine whether a refrigerant leak exists based on a time difference between a time associated with activation of the compressor and a subsequent time associated with the pressure falling below a threshold value.

The present disclosure further relates to a diagnostic mode method of operation of a heating, ventilating, and air conditioning (HVAC) unit having a refrigeration circuit. The diagnostic mode method includes activating a compressor and closing an expansion valve of the refrigeration circuit such that the compressor is active and the expansion valve is closed during a timeframe. The diagnostic mode method also includes measuring, during the timeframe, a pressure of the refrigerant in the refrigeration circuit using a sensor of the refrigeration circuit that is positioned downstream of the expansion valve and upstream of an evaporator of the refrigeration circuit. Additionally, the diagnostic mode method includes determining a pump-down time as a difference between a beginning of the timeframe and a time associated with reaching a threshold value for the pressure. Furthermore, the diagnostic mode method includes determining whether a refrigerant leak exists based on a comparison between the determined pump-down time and an expected pump-down down.

DETAILED DESCRIPTION

The present disclosure is generally directed to detecting refrigerant leaks in HVAC systems. As discussed above, an HVAC system generally includes a refrigerant flowing within a refrigeration circuit. The refrigerant flows through multiple conduits and components while undergoing phase changes to enable the HVAC system to condition an interior space of a structure. In certain embodiments, the refrigerant may include R-32, R-452B, R-134A, R-447A, R-455A, R-1234ze, R-1234yf, R-454A, R-454C, and R-454B. The present techniques enable HVAC systems to reliably detect and manage refrigerant leaks.

More specifically, the present disclosure relates to a diagnostic mode that may be implemented by an HVAC system to determine a volume of refrigerant within the HVAC system and, thereby, determine whether a refrigerant leak exists. As set forth below, present embodiments generally involve particular control strategies in which an HVAC controller provides suitable control signals to instruct a compressor of an HVAC unit to drive refrigerant into an outdoor portion of a refrigeration circuit, such as a condenser of the refrigeration circuit, during an off-cycle of a HVAC unit. As discussed below, the disclosed HVAC unit includes at least one high-sensitivity pressure sensor that is capable of measuring pressures within the refrigeration circuit that are substantially lower than those typically encountered during active operation of the HVAC unit. Using pressure data collected from such a sensor, the HVAC controller monitors an amount of time that the compressor operates to drive the refrigerant into the outdoor portion of the HVAC unit. Specifically, when the pressure in a portion of the refrigeration circuit falls below a threshold pressure value, the refrigerant is determined to have been driven to the outdoor portion of the HVAC unit. The HVAC controller subsequently compares this amount of time to an expected amount of time to determine whether a refrigerant leak is present in the refrigeration circuit. Furthermore, the HVAC controller can determine the expected amount of time based on previous iterations of the diagnostic mode, as well as data acquired by sensors of the HVAC unit. In other words, the expected amount of time may be updated by the HVAC unit and vary between iterations of the diagnostic mode. Accordingly the presently disclosed control strategy effectively enables the HVAC controller to determine whether a refrigerant leak exists.

Figure 1:
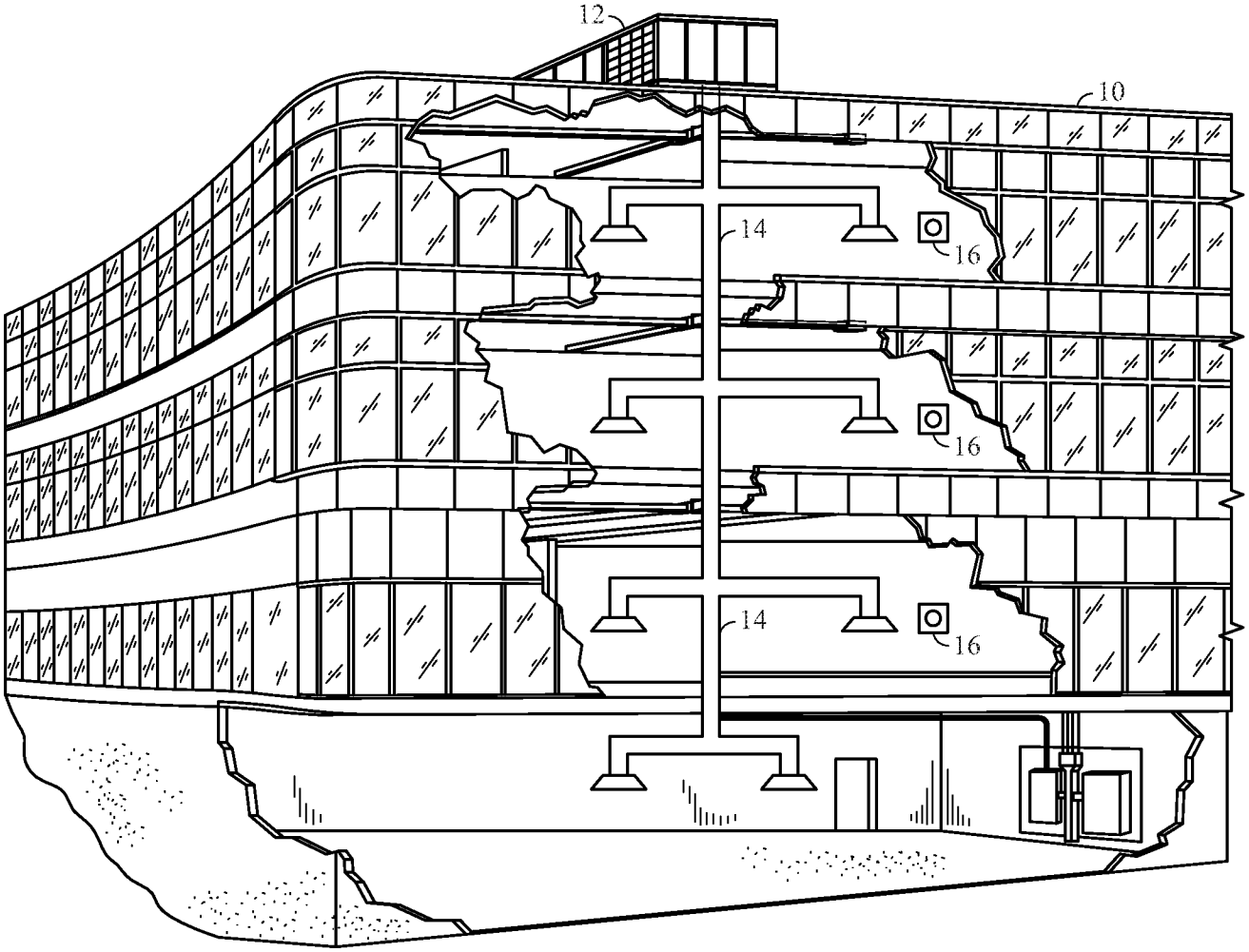
FIG. 1 is a perspective view of a packaged or commercial heating, ventilating, and air conditioning (HVAC) system for building environmental management, in accordance with embodiments described herein.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
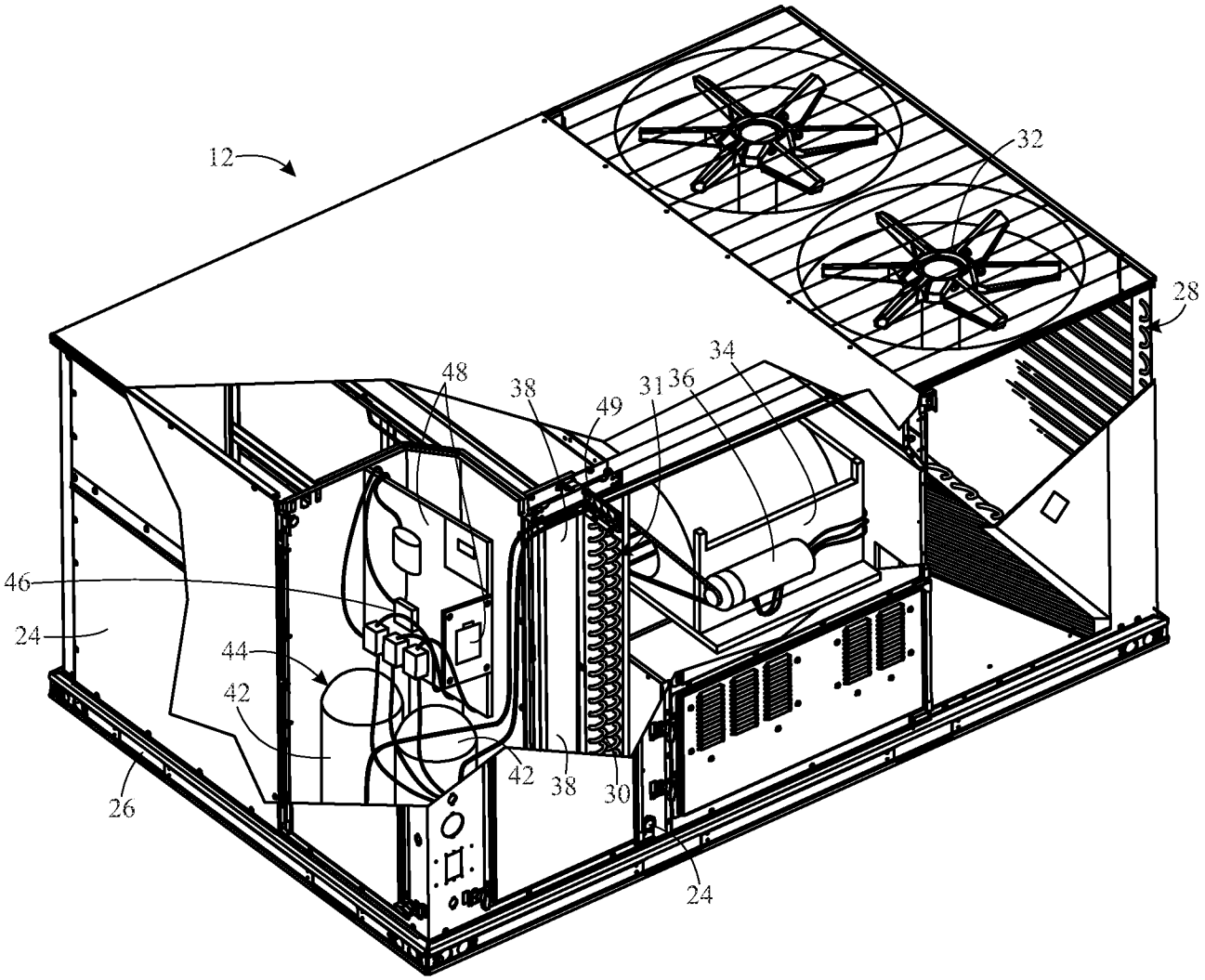
FIG. 2 is a perspective view of the HVAC unit of FIG. 1, in accordance with embodiments described herein.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
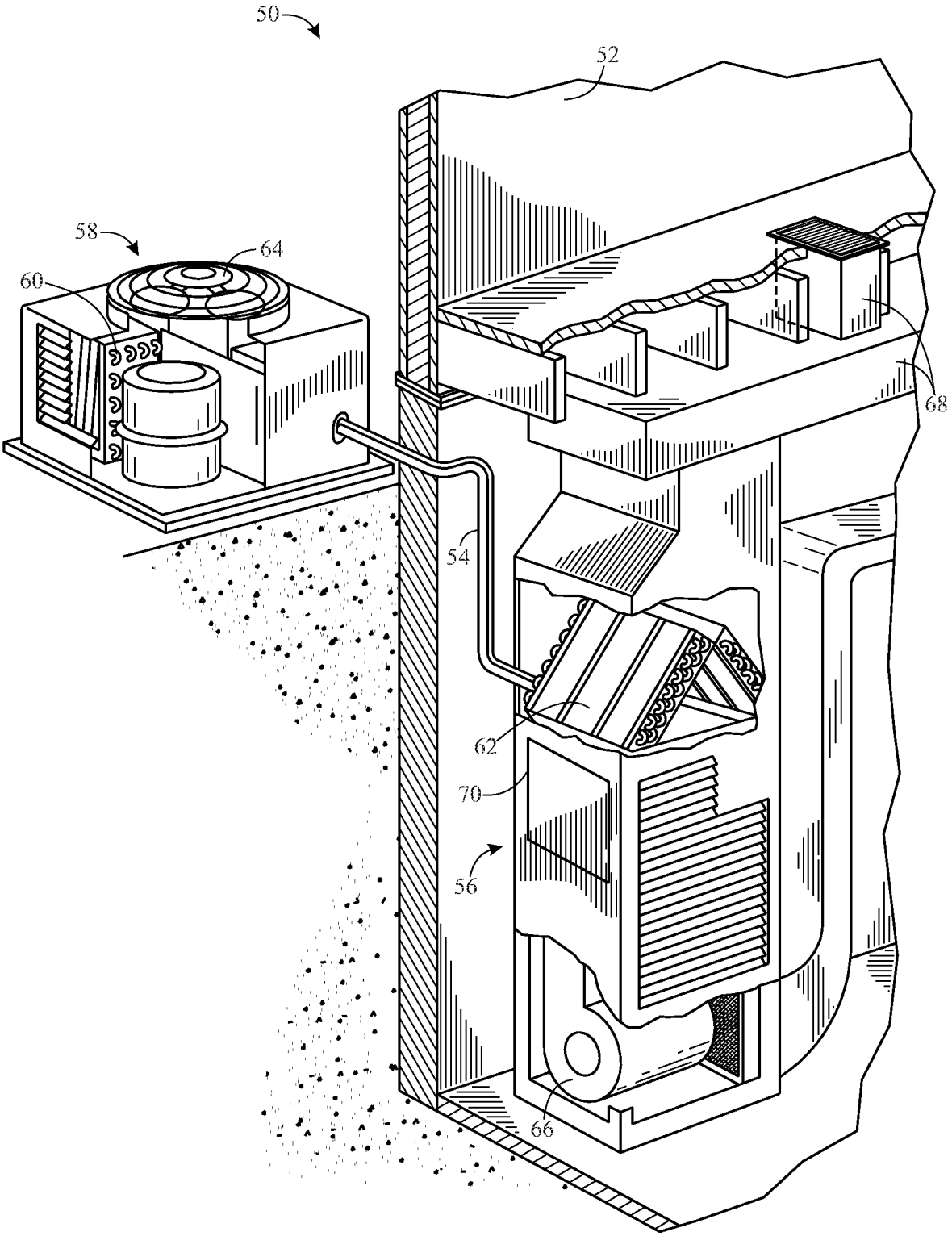
FIG. 3 is a perspective view of a residential HVAC system, in accordance with embodiments described herein.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
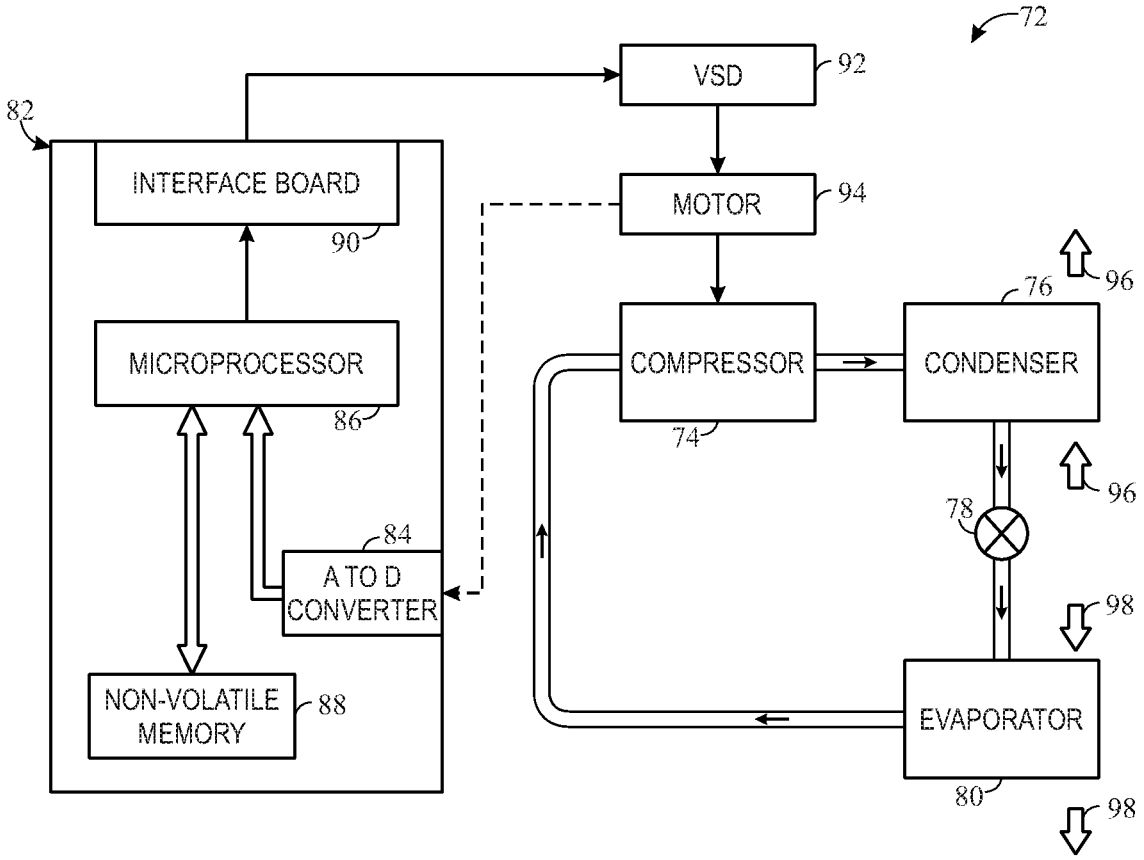
FIG. 4 is a schematic diagram of a vapor compression system that may be used in the HVAC system of FIG. 1 and the residential HVAC system of FIG. 3, in accordance with embodiments described herein.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator 80 relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, HVAC units such as HVAC unit 12 may include a refrigerant that is used to condition air before the conditioned air is sent to a conditioned space, such as a conditioned interior space of building 10. For instance, the refrigerant may be a refrigerant or be a mixture of one or more compounds. As discussed below, a controller may cause the HVAC unit 12 to undergo a diagnostic mode, which is a refrigerant leak testing mode used to determine whether a refrigerant leak exists. For instance, normal operation of the HVAC unit 12 may be stopped, and the refrigerant disposed within a refrigeration circuit of the HVAC unit 12 may be pumped into an outdoor portion of a refrigeration circuit. Based partly on pressure values sensed by a pressure sensor, the control panel 82 determines how long the compressor 74 is operated with the expansion valve 78 closed to drive the refrigerant into the outdoor portion of the refrigeration circuit, and compares this amount of time to an expected amount of time to determine whether a refrigerant leak is present.

As used herein, "pump-down time" refers to the amount of time that the compressor 74 is operated with the expansion valve 78 closed to pump the refrigerant into an outdoor portion of the vapor compression system 72. As discussed below, pump-down times may be determined by finding the difference between a first time (associated with the expansion valve 78 being closed and the compressor 74 being activated to initiate the pump-down process) and a second time (associated with a measured pressure value falling below a predetermined pressure value). Additionally, using data collected during execution of the diagnostic mode, the control panel 82 may determine and update the expected amount of time to account for variations between subsequent executions of the diagnostic mode, such as ambient temperature variations, ambient pressure variations, and aging of the HVAC system.

Figure 5:
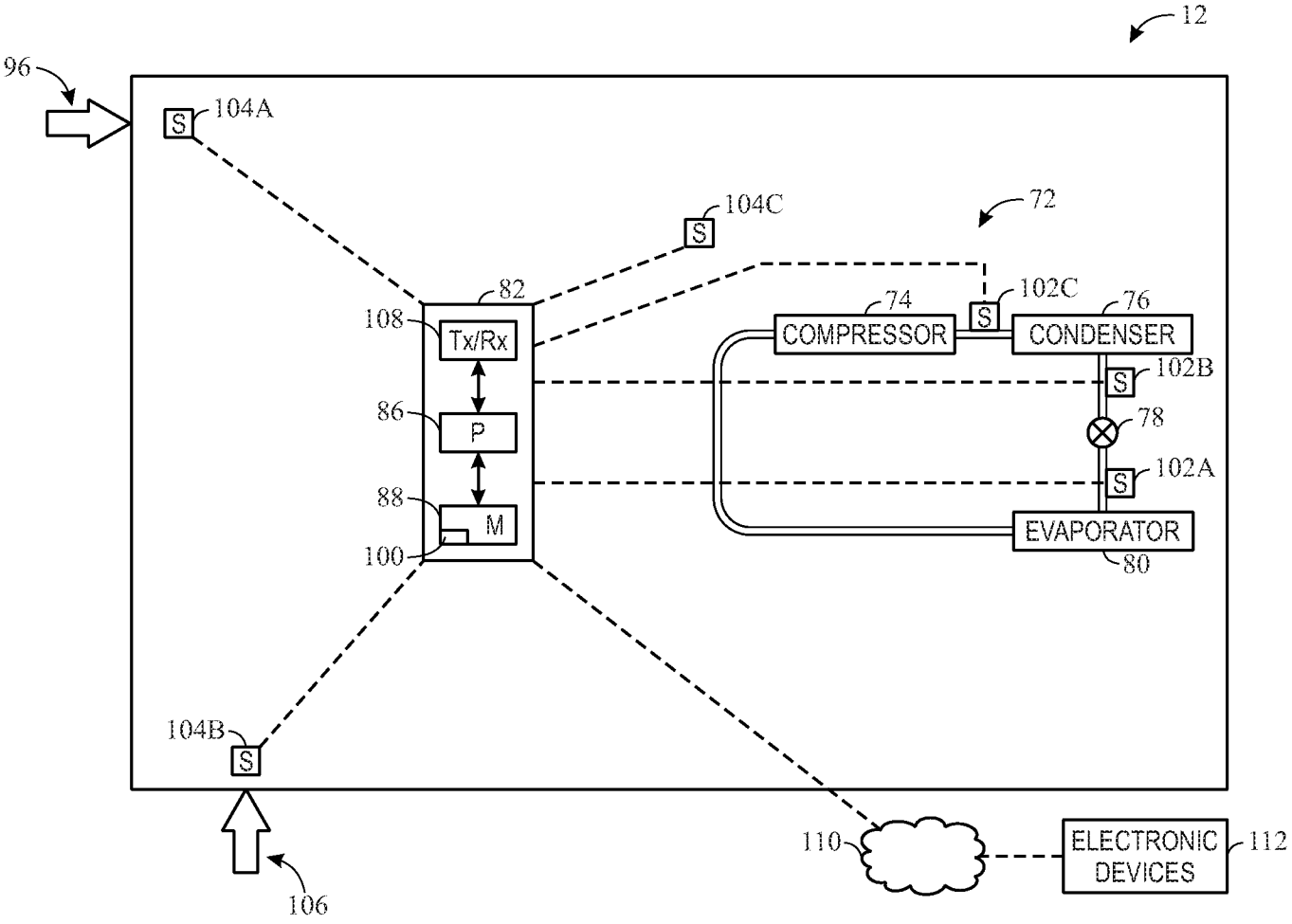
FIG. 5 is a schematic diagram of the HVAC unit of FIG. 2, in accordance with embodiments described herein.

With the foregoing discussion in mind, FIG. 5 is a schematic diagram of an embodiment of the HVAC unit 12. The HVAC unit 12 is capable of implementing a diagnostic mode in which processor 86 of the control panel 82 determines whether there is a refrigerant leak in the vapor compression system 72. While the discussion of the diagnostic mode is discussed in relation to the HVAC unit 12, it should be noted that the diagnostic mode may be implemented in HVAC systems that include other types of HVAC units. For example, the diagnostic mode may be implemented in the residential heating and cooling system 50 of FIG. 3. Furthermore, the diagnostic mode may be implemented by processor 86 executing instructions stored on the memory 88. For example, the memory 88 may include a profile 100 and instructions for implementing the diagnostic mode, as discussed in detail below.

During the diagnostic mode, refrigerant in the vapor compression system 72 is pumped into and stored within the condenser 76. More specifically, the processor 86 sends signals to close the expansion valve 78 of the vapor compression system 72 and sends signals to the compressor 74 to begin pumping the refrigerant into the condenser 76. For example, the expansion valve 78 may be an electronic expansion valve that can be controlled via the processor 86, and the processor 86 may send a signal that causes the expansion valve 78 to close so that the refrigerant cannot flow from the condenser 76 to the evaporator 80. With the expansion valve 78 closed, the compressor 74 may begin to pump the refrigerant into the condenser 76. Moreover, it should be noted that the illustrated processor 86 may be representative of multiple processors, in certain embodiments.

The diagnostic mode may be executed by the control panel 82 when the HVAC unit 12 is not supplying conditioned air to a conditioned space. For instance, in an on-cycle, the HVAC unit generally supplies heated or cooled air to a conditioned space, whereas in an off-cycle, the HVAC unit does not generally supply conditioned air to the conditioned space. The disclosed diagnostic mode is executed when the HVAC unit is in an off-cycle. Additionally, the processor 86 may cause the HVAC unit 12 to enter the off-cycle, which may include deactivating fans associated with the condenser 76 and evaporator 80 and deactivating the compressor 74, before executing the diagnostic mode.

Continuing with the discussion of the diagnostic mode, sensor data may be utilized by the processor 86 to determine whether a refrigerant leak is present. As illustrated, the HVAC unit 12 includes sensors 102 that are communicatively coupled to the processor 86. The sensors 102 may collect data regarding the refrigerant in the vapor compression system 72. For example, the data collected by the sensors 102 may be indicative of a pressure, temperature, or other characteristic of the refrigerant at various points within the refrigeration circuit. In certain embodiments, one or more of the sensors 102 may provide collect data regarding the refrigerant when the HVAC unit 12 is active, such as during an on-cycle, or when the HVAC unit 12 is in diagnostic mode or a combination thereof.

For instance, in the illustrated embodiment, sensor 102A measures a pressure of the refrigerant between the expansion valve 78 and the evaporator 80. However, rather than being a relatively high pressure sensor designed to measure pressures of the refrigerant of the HVAC unit 12 during an on-cycle, the illustrated sensor 102A is a high-sensitivity, low pressure sensor that can accurately measure low pressures and/or negative pressures, such as pressures near or below atmospheric pressure. For example, as mentioned, during performance of the diagnostic mode, the expansion valve 78 is closed and refrigerant is pumped into the condenser 76 and allowed to accumulate therein. As the refrigerant is pumped into the condenser 76, the pressure measured by the sensor 102A decreases. When a substantial portion, such as 95% or more, of the refrigerant has been pumped into the condenser 76, the pressure measured by the sensor 102A is substantially lower in comparison to pressures typically present during normal operation of the HVAC unit 12. For example, pressures measured by the sensor 102A may be substantially lower than typical pressures that occur during active operation of the HVAC unit 12. More specifically, the pressures measured by the sensor 102A may be less than 10% of pressures experienced during active operation of the HVAC unit 12 and/or below atmospheric pressure. Indeed, in some cases, data collected by the sensor 102A during normal, on-cycle operation may not accurately reflect a pressure within the refrigeration circuit as it would be beyond the functional pressure range of the sensor 102A. That is, the sensor 102A may be used specifically to detect low pressures that are present within portions of the vapor compression system 72 during the diagnostic mode, and therefore may not provide any meaningful measurements during normal, on-cycle operation of the HVAC unit 12.

Based on data received from the sensor 102A, the processor 86 determines a pressure within the refrigeration circuit between the expansion valve 78 and the evaporator 80 during diagnostic mode operation. The profile 100 stored within memory 88 may include data pertaining to a predetermined pressure value, and the processor 86 may determine whether data from the sensor 102 is lower than the predetermined pressure value. For instance, the predetermined pressure value may correspond to a minimum target pressure that should occur between the expansion valve 78 and the evaporator 80 when substantially all of the refrigerant has accumulated in the condenser 76. Thus, when the processor 86 determines that the data from sensor 102 is indicative of a pressure that is lower than the predetermined pressure value, then the processor 86 may determine that substantially all of the refrigerant has accumulated in the condenser 76.

In the event of a refrigerant leak, it may be the case that the pressure determined based on the data from the sensor 102A does not reach a value lower than the predetermined pressure value. For instance, an opening from which refrigerant can leak may form in the refrigeration circuit, and air may enter the opening, causing the pressure measured by the sensor 102A to stay above the predetermined pressure value. As another example, the pressure may not fall below the predetermined pressure value due to a faulty expansion valve 78. For instance, the expansion valve 78 may not sufficiently close to stop refrigerant from traversing the valve 78 and returning to an indoor portion of the vapor compression system 72. The profile 100 may include data regarding a maximum measurement time, which is a maximum amount of time that the compressor 74 should operate with the expansion valve 78 closed before which the pressure indicated by sensor 102A should fall below the predetermined pressure value. For instance, a time corresponding to when the processor 86 sends a signal to activate the compressor 74 to begin pumping refrigerant into the condenser 76 may be stored in the memory 88. When a second, later time is reached without the data from the sensor 102A having been determined to be indicative of a pressure below the predetermined pressure value, the processor 86 may determine that the maximum measurement time has been exceeded, which may be one indication that a refrigerant leak exists.

While the amount of time spent pumping the refrigerant into the condenser 76 may be based on pressure data solely acquired by the sensor 102A, in other embodiments, data from the sensors 102B and 102C may also be used. For example, the processor 86 may determine that substantially all of the refrigerant has been pumped into the condenser 76 when data from two or more of the sensors 102 are indicative of predetermined pressure values. More specifically, the profile 100 may include predetermined pressure values, such as minimum and/or maximum pressure thresholds, that are associated with the sensors 102B and 102C, in addition to the sensor 102A. Furthermore, time differences that are explained in relation to data acquired by the sensor 102A may also be determined based on data from sensors 102B and 102C, and the sensors 102B and 102C may have values associated with those time differences stored in the memory 88 and/or determinable by the processor 86. The time differences may be expected pump-down times. Moreover, while the illustrated embodiment includes three sensors 102, other embodiments may include a single sensor 102, two sensors 102, or more than three sensors 102.

However, at any point in time before the maximum amount of time has occurred, the processor 86 may process the data from the sensor 102A to determine whether the pressure indicated by the sensor 102A is below the predetermined pressure value. When the pressure drops below the predetermined pressure value, the processor 86 may determine a time difference between sending the signal to activate the compressor 74 and the pressure dropping below the predetermined pressure value. In other words, the time difference corresponds to an amount of time that passes between a first time associated with when the compressor 74 begins to pump the refrigerant into the condenser 76 and a second time associated with when substantially all of the refrigerant is located in the condenser 76.

The processor 86 may determine whether a leak is present based on the time difference. More specifically, the processor 86 may determine whether a leak is present by comparing the time difference to an expected pump-down time, which an expected amount of time to pass between when the compressor 74 begins to pump the refrigerant into the condenser 76 and when substantially all of the refrigerant is located in the condenser 76. The expected pump-down time is determined by the processor 86 based on previous iterations of the diagnostic mode as well as air temperature values. The expected pump-down time may also be determined based on other factors such as a rate at which the compressor 74 can pump the refrigerant into the condenser 76 and an amount of refrigerant, such as a volume of refrigerant expected to be present in the refrigeration circuit. For instance, the volume of refrigerant expected to be present in the refrigeration circuit may be a volume of refrigerant originally put into the refrigeration circuit before the HVAC unit 12 began supplying conditioned air to the building 10. Additionally, the profile 100 may include an initial value of the expected pump-down time that can be modified by the processor 86 based on one or more air temperature values sensed by one or more sensors 104 that are communicatively coupled to the processor 86. That is, the sensors 104 are capable of sending signals to the processor 86 regarding detected air temperatures. More specifically, sensor 104A may collect data regarding a temperature of environmental air 96, sensor 104B may collect data regarding a temperature of return air 106, and sensor 104C may measure a temperature of air within the HVAC unit 12 near a component of the vapor compression system 72, where "near" means within approximately 6 feet. In some embodiments, the sensor 104C may be directly coupled to a component of the vapor compression system 72.

It is presently recognized that air temperature within the HVAC unit 12 and outside of the HVAC unit 12 can affect properties of the refrigerant, which can cause differences in the amount of time required to pump substantially all of the refrigerant into the condenser 76. For instance, as described by Gay-Lussac's Law (reproduced below), for a fixed volume, such as a volume within the refrigeration circuit of the vapor compression system 72, an increase or decrease in temperature causes a corresponding increase or decrease in pressure, respectively. Additionally, changes in pressure can affect the amount of time it takes to pump the refrigerant into the condenser 76. The processor 86 may receive the data from sensors 104 to determine various temperatures such as an environmental air temperature, a return air temperature, an air temperature near the refrigeration system. The processor 86 may determine an expected pump-down time based at least partially on one or more of the determined temperature values. For example, the profile 100 may include a default pump-down time that is applicable when the environmental air 96, return air 106, or air near the vapor compression system 72 is a specific temperature. Accordingly, the processor 86 may determine an expected pump-down time for temperatures other than the specific temperature associated with default pump-down time based on sensed temperature values. For instance, a pressure relative to a default pressure value stored on the memory 88 may be determined based on sensed temperatures values. A look-up table also included on the memory 88 may describe a pump-down times or deviations from a default pump-down time associated with the various detected temperatures and/or pressures determined based on the sensed values. Accordingly, the processor 86 may determine an expected amount pump-down time based on one or more temperature values determined based on the data collected from the sensors 104.

$$\frac{P_1}{T_1} = \frac{P_2}{T_2}$$

Moreover, the expected pump-down time may be determined based on the previous iterations of the diagnostic mode. For instance, previous times required to pump the refrigerant into the condenser 76 may have been determined in the manner described above and stored on the memory 88. Other data associated with previous executions of the diagnostic mode may also be stored in the memory 88, such as temperatures indicated by the sensors 104. The processor may then determine an expected pump-down time based on previously recorded pump-down times that occurred at the same or similar temperatures. For instance, one or more iterations of the diagnostic mode may be performed at the time of installation of the HVAC unit 12. The pump-down times and temperatures indicated by the sensors 104 during execution of the diagnostic mode may be stored on the memory 88, and the processor 86 may determine expected pump-down times based on the pump-down times and temperatures recorded in the memory 88 from the initial iteration(s) of the diagnostic mode.

The processor 86 may determine a leak is present when a measured pump-down time is less than the expected pump-down time. For instance, when a leak is present, less refrigerant is present in the refrigeration circuit. Due to the reduced amount of refrigerant, it would take less time to pump the refrigerant into the condenser 76. In some embodiments, the processor may determine that a leak exists solely based on whether a determined pump-down time is less than the expected pump-down time. However, in other embodiments, the processor 86 may determine a refrigerant leak exists based on whether the determined pump-down time is a predetermined amount shorter than the expected pump-down time. For instance, the processor 86 may determine that a refrigerant leak has occurred when a determined pump-down time is less than a certain percentage of the expected pump-down time, such as 80%, 85%, 90%, 95%, or any other suitable percentage less than 100%. Additionally, as mentioned, the processor 86 may also determine that a leak of refrigerant exists when the pressure between the expansion valve 78 and the compressor 74 on the evaporator 80 side of the refrigeration circuit is unable to fall below the predetermined pressure value after operating the compressor 74 for a maximum measurement time. For instance, in the event an opening forms in the refrigeration circuit and air enters the opening, the measured pressure may not fall below the predetermined pressure value. However, in such a case, the maximum measurement time may be met or exceeded, and, in response, the processor 86 may determine that a refrigerant leak exists.

Utilizing the sensors 102A and 102B, the processor 86 may also determine whether the expansion valve 78 is defective and does not closed sufficiently to stop the flow of refrigerant into the evaporator 80. That is, the processor 86 may determine whether refrigerant continues to pass from the condenser 76 to the evaporator 80 while the diagnostic mode is performed. More specifically, the processor 86 may determine pressure values based on data sensed by the sensors 102A, 102B, and/or 102C to make such a determination. For example, pressure values associated with the sensor 102A may initially decrease after the compressor 74 begins to pump the refrigerant into the condenser 76, while pressure values associated with the sensor 102B may increase. However, as pressure begins to build on the condenser side of the faulty expansion valve 78, a small amount refrigerant may begin to traverse the valve 78, preventing the pressure threshold from being reached. As such, in certain embodiments, when the maximum measurement time is reached without the pressure threshold being reached, the processor 86 may identify whether the issue is a refrigerant leak (e.g., indicated when at least one of the measured pressure values of either sensor 102A or 102B is substantially constant) or a faulty expansion valve (e.g., indicated when the measured pressure value of sensor 102A increases while the measured pressure value of the sensor 102B decreases by a corresponding amount).

Similarly, the processor 86 may determine whether certain types of leaks are present. For example, the processor 86 may determine whether refrigerant is leaking out of the refrigeration circuit or whether air is entering the refrigeration circuit during diagnostic mode operation. For instance, when the maximum measurement time has been met or exceeded without the pressure having fallen below the predetermined pressure value and pressure equilibria are not indicated by the sensors 102A and 102B, the processor 86 may determine that air is entering the refrigeration circuit. As another example, when a measured pump-down time is less than an expected pump-down time, the processor 86 may determine that the refrigerant is leaking out of the refrigeration circuit. Additionally, the sensor 102C may be used instead of the sensor 102B or in combination with the sensors 102A and 102B.

When the processor 86 determines that a refrigerant leak exists, the processor 86 may take several actions. For example, the processor 86 may send a signal to activate an alarm system in the building 10 and/or otherwise indicate that a refrigerant leak is present. For instance, the processor 86 may be send signals to a transceiver 108 that can transmit data to and receive data from a network 110. Via the network 110, the processor 86 may send signals to cause notifications and/or alarms on other electronic devices 112, such as computers, tablets, and phones. For example, the electronic devices 112 may receive emails, phone calls, SMS messages, or other forms of notifications based on signals sent from the processor 86. The notifications may also include the type of leak, such as whether a leak corresponds to air entering the refrigeration circuit or refrigerant exiting the refrigeration circuit.

Additionally, in the event a leak is determined to be present, the processor 86 may prevent the HVAC unit 12 from resuming normal operation. That is, the processor 86 may prevent the HVAC unit 12 from entering an on-cycle. For example, the processor 86 may send a signal indicative of a lock-down mode in which the HVAC unit 12 ceases all operations. In any case, when a leak is detected, the processor 86 may ensure that the expansion valve 78 remains closed and that the refrigerant remains in the condenser 76. For example, data from the sensors 102B, 102C may be used to monitor the refrigerant.

When the processor 86 determines that a leak does not exist, the processor 86 may allow the HVAC unit 12 to resume normal operation. In other words, the processor 86 may allow the HVAC unit 12 to enter an on-cycle. For instance, the processor 86 may send signals that cause the diagnostic mode to end, open the expansion valve 78, and/or otherwise cause the HVAC unit 12 to resume normal operation. In other words, the signals sent by the processor 86 may allow the HVAC unit 12 to resume supplying conditioned air to the building 10.

Figure 6:
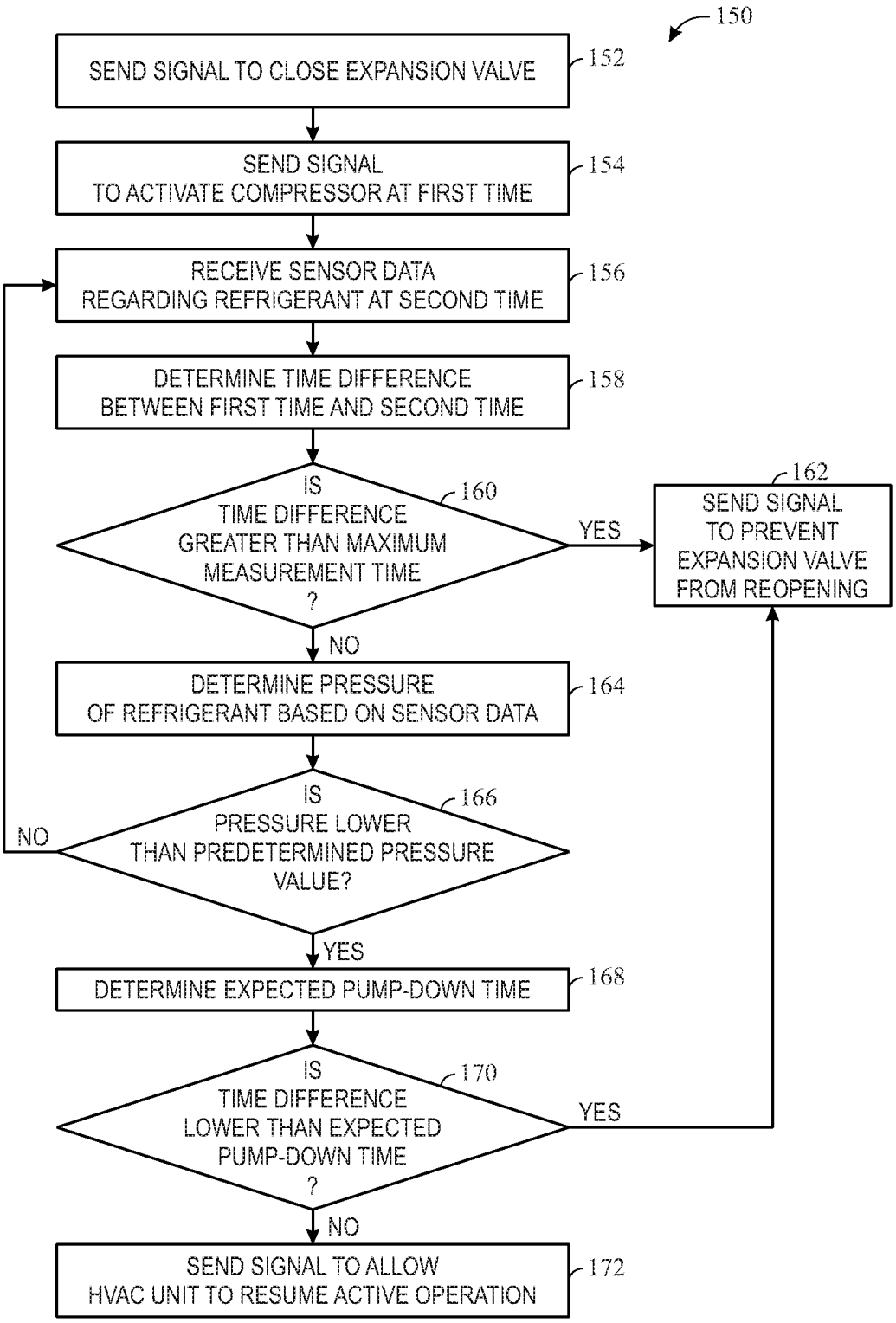
FIG. 6 is a flow diagram of a process for determining whether a refrigerant leak exists in the HVAC unit, in accordance with embodiments described herein.

Keeping the discussion of FIG. 5 in mind, FIG. 6 is a flow diagram of an embodiment of a process 150 for determining whether a refrigerant leak is present in an HVAC unit or, more specifically, the vapor compression system 72. The process 150 may be performed by the processor 86 by executing instructions stored on the memory 88, or other suitable processing circuitry, in accordance with the present disclosure.

At block 152, the processor 86 sends a signal to close the expansion valve 78. As described above, the expansion valve 78 may be an electronic expansion valve that is communicatively coupled to the processor 86 and capable of being opened and closed based on signals from the processor 86. By closing the expansion valve 78, the refrigerant of the vapor compression system 72 is not able to flow from the condenser 76 to the evaporator 80.

At block 154, the processor 86 sends a signal, such as a control signal, at a first time to activate the compressor 74 to pump refrigerant into the condenser 76. Additionally, the first time may be recorded in the memory 88. It should be noted that the first time may not necessarily be the same time that the compressor 74 begins to operate with the expansion valve 78 closed. That is, the first time may be a time associated with the activation of the compressor 74 and/or the closure of the expansion valve 78. For instance, the first time may be a time that occurs before or after the compressor 74 is activated and/or the expansion valve 78 is closed. At block 156, the processor 86 receives, at a second time, data from sensors 102. As described above, the data from sensors 102 may be indicative of pressures of the refrigerant at various portions of the vapor compression system 72. The data received by the processor 86 includes data from sensor 102A. As discussed above, the sensor 102A can be a high-resolution, low pressure sensor that is generally located between the expansion valve 78 and the compressor 74. Similar to the first time, the second time may not necessarily be the time that the data is received by the processor 86. For instance, the second time may be a time that is associated with the processor 86 receiving the data.

At block 158, the processor 86 determines a time difference between the first time and the second time. In other words, the processor 86 determines a pump-down time, which is the amount of time that passes before all or substantially all of the refrigerant is stored in the condenser 76. At block 160, the processor 86 determines whether the time difference is greater than a maximum measurement time. The maximum measurement time is an amount of time that may be stored on the memory 88. As mentioned above, the maximum measurement time being exceeded may be indicative of a refrigerant leak. Accordingly, when the processor 86 determines that the time difference is greater than the maximum measurement time, at block 162, the processor 86 sends a signal to prevent the expansion valve 78 from reopening. In other words, the processor 86 may prevent the HVAC unit 12 from exiting the diagnostic mode and/or providing conditioned air to the building 10. For instance, the signal may cause the HVAC unit 12 to implement the lock-down mode described above. However, if the processor 86 determines that the time difference is not greater than the maximum measurement time, the processor 86 may proceed to block 164.

At block 164, the processor 86 determines a pressure of the refrigerant based on the data from the sensors 102. For instance, the processor 86 may determine a pressure between the expansion valve 78 and the evaporator 80 based on data collected via the sensor 102A. At block 166, the processor 86 determines whether the pressure determined at block 158 is lower than a predetermined pressure value. As previously described, the predetermined pressure value may be stored on the profile 100 of the memory 88, and the predetermined pressure value may correspond to a pressure value that occurs when substantially all of the refrigerant is located within the condenser 76. If the processor 86 determines that the pressure is not lower than the predetermined pressure value, the processor 86 may continue to receive data from the sensors 102, as indicated at block 156.

However, if the processor 86 determines that the pressure is lower than the predetermined pressure value, at block 168, the processor 86 determines an expected pump-down time. As described above, the processor 86 may determine the expected pump-down time based on previous iterations of the diagnostic mode and data from the sensors 104. At block 170, the processor 86 determines whether the time difference is substantially lower than an expected pump-down time. If the processor 86 determines that the time difference is substantially lower than the expected pump-down time, the processor 86 may send a signal to prevent the expansion valve 78 from reopening, as indicated by block 162. However, if the processor 86 determines that the time difference is not less than the expected pump-down time, at block 168, the processor 86 may send a signal that allows the HVAC unit 12 to resume active operation. Determining whether the time difference is substantially lower than the expected pump-down time allows for a tolerance, such as one percent, so that the processor 86 does not proceed to block 162 in response to time differences that are approximately equal to the expected pump-down time, where "approximately equal" means differing from the expected pump-down time but within the tolerance. Additionally, when a time difference between the first and second times is slightly lower, such as within one percent, of the expected pump-down time, the profile 100 may be updated so that an expected pump-down time in a future iteration of the process 150 may be adjusted. By updating the profile 100 in this manner, the processor 86 may account for drift or small cumulative changes over time as the refrigerant charge changes over time and/or the refrigeration circuit ages.

In other embodiments, the process 150 may include other steps. For example, before performing steps indicated by blocks 152 and 154, the processor 86 may determine that the HVAC unit 12 is not operating in a manner indicative of providing conditioned air to the building 10. That is, the processor 86 may determine whether the HVAC unit 12 is in an on-cycle or an off-cycle. The processor 86 may also send a signal to ensure that normal operation of the HVAC unit 12 is not being completed. In other words, the processor 86 may send a signal to exit an on-cycle. As another example, the process 150 may also include the processor 86 receiving data from the sensors 104.

While only certain features and embodiments of the present disclosure have been illustrated and described, many modifications and changes may occur to those skilled in the art without materially departing from the novel teachings and advantages of the subject matter recited in the claims. For instance, the modifications and changes may include variations in sizes, dimensions, structures, shapes and proportions of the various elements, values of parameters such as temperatures or pressures, mounting arrangements, use of materials, colors, orientations, and the like. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A refrigeration circuit, comprising:

a controller communicatively coupled to a compressor, an expansion valve, and a sensor of the refrigeration circuit, wherein the controller is configured to:

activate the compressor and actuate the expansion valve such that the compressor is active while the expansion valve is closed;

measure a pressure of a refrigerant in the refrigeration circuit using the sensor at least while the compressor is active and the expansion valve is closed;

determine whether a refrigerant leak exists based on a time difference between a first time associated with the compressor being active while the expansion valve is closed and a second time associated with the measured pressure falling below a threshold value; and block the expansion valve from opening when the refrigerant leak is determined to exist.

2. The refrigeration circuit of claim 1, wherein the controller is configured to close the expansion valve before activating the compressor.

3. The refrigeration circuit of claim 1, wherein the controller is configured to determine whether the refrigerant leak exists by comparing the time difference to an expected pump-down time or a maximum measurement time.

4. The refrigeration circuit of claim 3, wherein the controller is configured to determine that the refrigerant leak exists when the time difference is substantially shorter than the expected pump-down time due to a loss of refrigerant in the refrigeration circuit.

5. The refrigeration circuit of claim 3, wherein the controller is configured to determine that the refrigerant leak exists when the time difference is substantially longer than the expected pump-down time due to air leaking into the refrigeration circuit.

6. The refrigeration circuit of claim 3, wherein the controller is configured to determine that the refrigerant leak exists when the time difference equals or exceeds the maximum measurement time due to air leaking into the refrigeration circuit.

7. The refrigeration circuit of claim 3, wherein the controller is configured to determine the expected pump-down time based at least partially on previous pump-down times stored in a memory of the controller.

8. The refrigeration circuit of claim 7, comprising a temperature sensor communicatively coupled to the controller and configured to measure an air temperature associated with a heating, ventilating, and air conditioning (HVAC) unit, wherein the controller is configured to measure the air temperature using the temperature sensor and to determine the expected pump-down time at least partially based on the measured air temperature.

9. The refrigeration circuit of claim 8, wherein the air temperature corresponds to an environmental air temperature.

10. The refrigeration circuit of claim 8, wherein the air temperature corresponds to a return air temperature.

11. The refrigeration circuit of claim 1, wherein the threshold value is substantially lower than a refrigerant pressure associated with normal operation of the refrigeration circuit.

12. The refrigeration circuit of claim 1, comprising a second sensor disposed upstream of the expansion valve, wherein the sensor is disposed downstream of the expansion valve, and wherein the controller is configured to:

measure a second pressure of the refrigerant in the refrigeration circuit using the second sensor; and determine that the expansion valve is faulty when the pressure measured by the sensor decreases by a first amount corresponding to an increase of a second amount of the second pressure measured by the second sensor when a maximum measurement time is reached.

13. The refrigeration circuit of claim 1, wherein the controller is configured to determine whether the refrigerant leak exists based on a maximum measurement time being reached.

14. A heating, ventilating, and air conditioning (HVAC) unit, comprising:

a refrigeration circuit comprising a compressor and an expansion valve;

a sensor configured to measure a pressure of a refrigerant within the refrigeration circuit; and a controller configured to:

activate the compressor with the expansion valve closed;

obtain a measure of the pressure of the refrigerant from the sensor;

determine whether a refrigerant leak exists based on a time difference between a time associated with activation of the compressor and a subsequent time associated with the pressure falling below a threshold value; and block the expansion valve from reopening when the refrigerant leak is determined to exist.

15. The HVAC unit of claim 14, wherein the sensor is positioned downstream of the expansion valve and upstream of an evaporator of the refrigeration circuit.

16. The HVAC unit of claim 14, wherein, the controller is configured to stop the compressor when the measure of the pressure of the refrigerant does not fall below the threshold value within a set timeframe.

17. The HVAC unit of claim 14, wherein the controller is configured to determine an expected pump-down time, and wherein the controller is configured to determine that the refrigerant leak exists when the time difference is substantially more or substantially less than the expected pump-down time.

18. The HVAC unit of claim 14, comprising an environmental air sensor and a return air sensor communicatively coupled to the controller, wherein the controller is configured to:

measure an environmental air temperature associated with the HVAC unit using the environmental air sensor;

measure a return air temperature associated with the HVAC unit using the return air sensor;

determine an expected pump-down time based, at least in part, on the measured environmental air temperature and the return air temperature; and determine that the refrigerant leak exists when the time difference is substantially above or below the expected pump-down time.

19. The HVAC unit of claim 18, wherein the controller is configured to determine the expected pump-down time based at least partially based on previous pump-down times.

20. The HVAC unit of claim 14, comprising a second sensor communicatively coupled to the controller and configured to measure a second pressure of the refrigerant within the refrigeration circuit, wherein the sensor and the second sensor are disposed on opposite sides of the expansion valve in the refrigeration circuit, and wherein the controller is configured to obtain a second measure of the pressure of the refrigerant from the second sensor.

21. The HVAC unit of claim 20, wherein, when a maximum measurement time is reached, the controller is configured to:

determine whether the refrigerant leak exists or the expansion valve is faulty based, at least in part, on the measure and the second measure of the pressure of the refrigerant obtained by the sensor and the second sensor.

22. The HVAC unit of claim 14, wherein the controller is configured to send a signal to notify an electronic device of the refrigerant leak when the refrigerant leak is determined to exist.

23. The HVAC unit of claim 14, wherein the controller is configured to:

determine whether the HVAC unit is operating in an on-cycle based on initiating a diagnostic mode, and when the HVAC unit is operating in the on-cycle, switch the HVAC unit into an off-cycle and close the expansion valve before activating the compressor in the diagnostic mode.

24. A diagnostic mode method of operation of a heating, ventilating, and air conditioning (HVAC) unit having a refrigeration circuit, the method comprising:

activating a compressor and closing an expansion valve of the refrigeration circuit such that the compressor is active and the expansion valve is closed during a timeframe;

measuring a pressure of a refrigerant in the refrigeration circuit using a sensor of the refrigeration circuit positioned downstream of the expansion valve and upstream of an evaporator of the refrigeration circuit during the timeframe;

determining a pump-down time as a difference between a beginning of the timeframe and a time associated with reaching a threshold value for the pressure; and determining whether a refrigerant leak exists based on a comparison between the determined pump-down time and an expected pump-down time; and blocking the expansion valve from reopening to prevent on-cycle operation of the HVAC unit when the refrigerant leak is determined to exist.

25. The diagnostic mode method of operation of claim 24, wherein the threshold value corresponds to substantially all of the refrigerant of the refrigeration circuit being disposed in an outdoor portion of the refrigeration circuit.

26. The diagnostic mode method of operation of claim 24, comprising:

measuring an environmental air temperature associated with the HVAC unit using a second sensor;

measuring a return air temperature associated with the HVAC unit using a third sensor; and determining the expected pump-down time based on the measured environmental air temperature, the return air temperature, and a previous pump-down time.

27. The diagnostic mode method of operation of claim 24, wherein the expected pump-down time is determined based on an amount of the refrigerant in the refrigeration circuit.

28. A heating, ventilating, and air conditioning (HVAC) system, comprising:

a refrigeration circuit comprising a compressor and an expansion valve;

a sensor configured to measure a pressure of a refrigerant within the refrigeration circuit; and a controller configured to:

determine that the HVAC system is operating in an on-cycle when a diagnostic mode is initiated;

switch the HVAC system into an off-cycle;

activate the compressor with the expansion valve closed;

obtain a measure of the pressure of the refrigerant from the sensor; and determine whether a refrigerant leak exists based on a time difference between a time associated with activation of the compressor and a subsequent time associated with the pressure falling below a threshold value.

29. The HVAC system of claim 28, wherein the controller is configured to prevent the expansion valve from reopening when the refrigerant leak is determined to exist.

* * * * *